US006273472B1

(12) United States Patent
Pflug

(10) Patent No.: US 6,273,472 B1
(45) Date of Patent: Aug. 14, 2001

(54) PHOTO ALBUM ORGANIZER SYSTEM

(76) Inventor: John R. Pflug, 8510 Shadeway Pl., Springfield, VA (US) 22153

( * ) Notice: Subject to any disclaimer, the term of this patent is extended or adjusted under 35 U.S.C. 154(b) by 0 days.

(21) Appl. No.: 09/280,572

(22) Filed: Mar. 30, 1999

Related U.S. Application Data

(60) Provisional application No. 60/095,459, filed on Aug. 6, 1998.

(51) Int. Cl.[7] ..... B42D 15/00

(52) U.S. Cl. ..... 283/70; 283/67; 402/79

(58) Field of Search ..... 281/22, 21.1, 29, 281/38, 45; 402/73, 70, 79; 283/36, 67, 70

(56) References Cited

U.S. PATENT DOCUMENTS 2,542,754 * 2/1951 De Vry ..... 281/22 X
4,140,565 * 2/1979 Parker et al. ..... 281/22 X
5,183,296 * 2/1993 Policht ..... 281/22 X
5,403,138 * 4/1995 Otake et al. ..... 281/22 X

* cited by examiner

*Primary Examiner*—Willmon Fridie, Jr.
(74) *Attorney, Agent, or Firm*—Robert N. Blackmon

(57) ABSTRACT

A method and apparatus for organizing large amounts of photographs and for readily identifying storage volumes and their contents. Multiple binders are used in a series to store photographs. Each binder has photograph-receiving sheets for storing the photos to be viewed. Each binder in the series has information pertaining to the yearly span, date, family surname, subject matter, or other information to identify the material in the particular binder and in the series of binders to index the information into a readily usable form. Rapid increases in efficiency of indexing and usefulness of the photo albums is achieved by the orderly attachment of information to the pictures, binders, and series.

16 Claims, 2 Drawing Sheets

PHOTO ALBUM ORGANIZER SYSTEM

CROSS REFERENCE TO RELATED APPLICATIONS

This application is related to co-pending design application Ser. No. of John R. Pflug filed Mar. 30, 1999 entitled *Photo Album* which is hereby incorporated by reference. This application claims the benefit of U.S. Provisional Application 60/095,459 filed Aug. 6, 1998.

BACKGROUND OF THE INVENTION

1. Field of the Invention

The present invention relates to a system and method for organizing a large collection of photographs.

2. Descriptiuon of the Prior Art

Almost everyone has experienced the thrill of seeing themselves or their friends or their families in photographs taken at a birthday party, graduation, wedding or other special occassion. Photos last a lifetime and reflect on where one has been and with whom one has done them. Photographs can spark memories of past events and capture scenes from a time which has long since lapsed. Some families make photographs last beyond a lifetime by passing them down to their children and heirs.

Unfortunately, most photograph collections remain merely piles of photographs in a loose pile or in a rudimentary box. The photographs are disorganized and finding a photograph from a certain event or of a certain occasion remains a difficult if not impractical task. After a certain number of years, organizing the hundreds or even thousands of photographs that a person can easily collect over a lifetime becomes no small chore. The drive to organize all of the photographs is further curtailed by the limited types and varieties of photo album available to the public.

There remains a great need for a system of collecting photographs which can organize not only the photographs of one event, but a systematic solution for organizing volumes of albums worth of photographs into a neat and indexable sytem.

SUMMARY OF THE INVENTION

Accordingly, it is a principal object of the invention to provide a photo album which is sized and constructed to provide a convenient, attractive, and useful storage and organization device for photographs.

It is another object of the invention to provide a method of marking series of albums to provide a system for collecting and organizing large numbers of photographs into an systematized, multi-volume display.

It is a further object of the invention to provide a method of sorting, storing, and retrieving a large amount of photographs in a multi-volume photo album collection.

Still another object of the invention is to provide a photo album which is capable of receiving a plurality of photo-retaining sheets and which has indicia printed on an outer surface of the photo album representing information relevant to the collection of photographs for indexing the photograph collection.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 2:
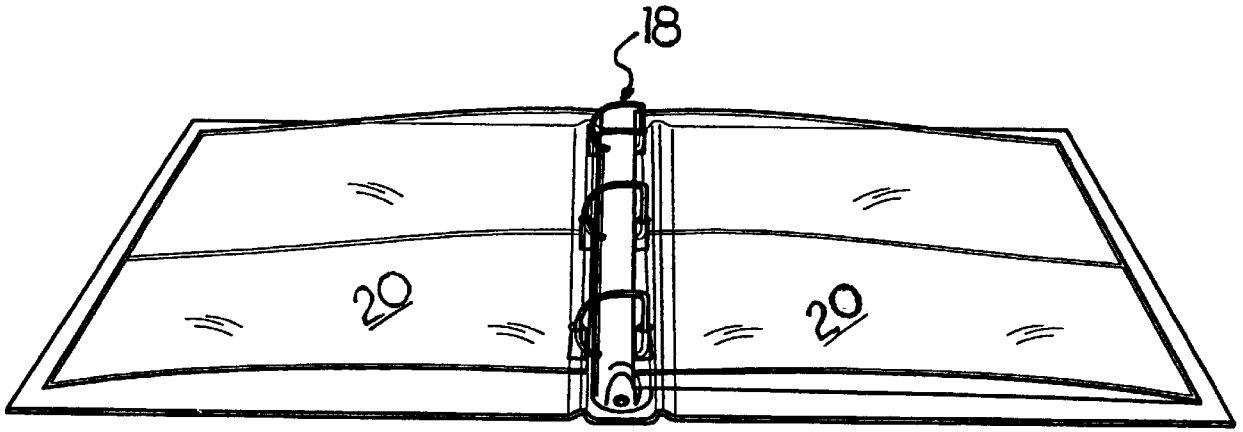
FIG. 2 is an environmental perspective view of the interior section of a photo album according to the present invention.
Figure 1:
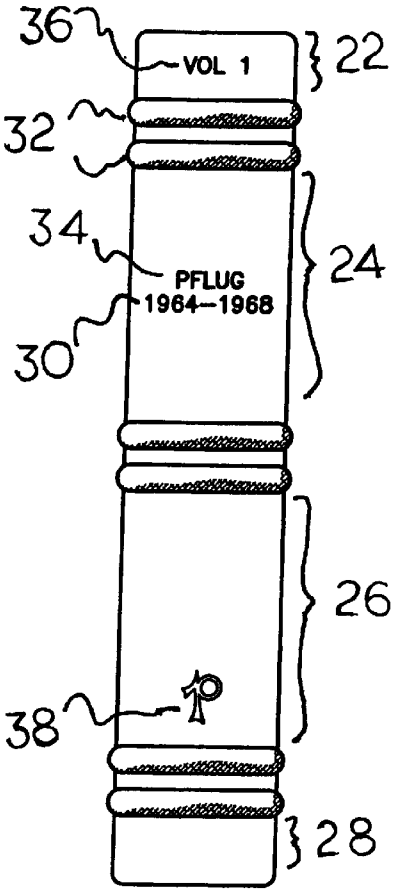
FIG. 1 is side elevation view of a photo album according to the present invention.
Figure 3:
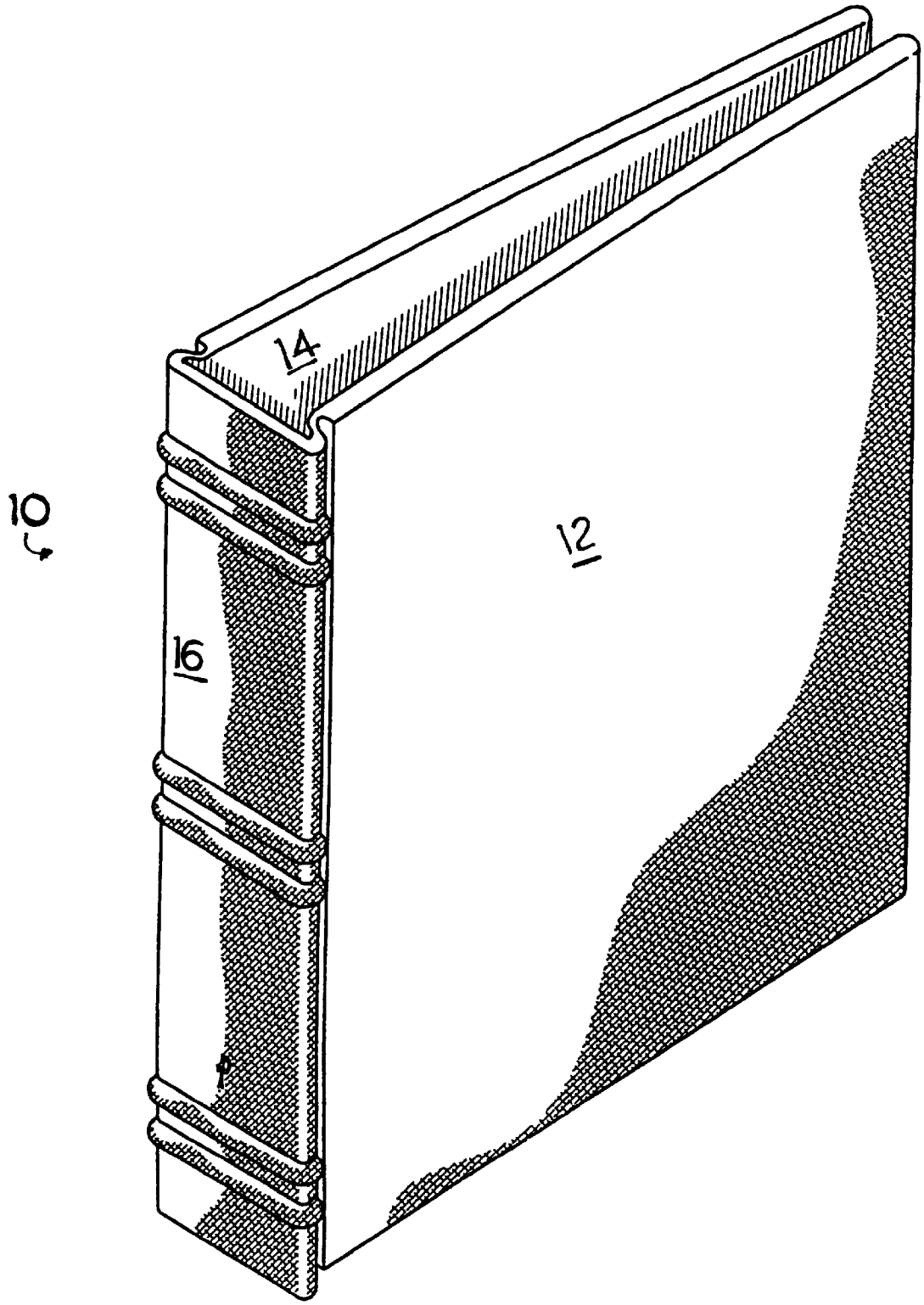
FIG. 3 is an environmental perspective of the exterior of a photo album according to the present invention.

The present invention as is shown in FIGS. 1–3, is to a photograph collection system which has as its basis a photo album 10 having an exterior comprising a front cover 12, a rear cover 14, and an intermediate spine 16 attached between the covers. Preferably an outer layer of the album 10 is made of a leather material to present a pleasing and consistent look of the album. A series of matching albums all having a similar cover material can be provided as part of the photograph collection system as will be discussed in further detail below.

As shown in FIG. 2, the interior of the book has a binder system 18 shown with a three ring binder, though many different binder systems could be used for a similar purpose. The binder holds and maintains a number of photograph receiving sheets 20 which receive photographs (not shown) in the pockets or other retaining devices of the sheet 20 to display the photographs in book form.

FIG. 1 shows the spine 16 of the photo album. The spine preferably has raised flat. indicia receiving surfaces 22,24, 26,28 separated by raised or printed dividers 30. The number of indicia receiving surfaces and dividers will depend on the amount of information to be recorded on the album and the overall appearance desired. The indicia to be recorded on the album represent information pertaining to the collection of photographs within the album. According to the preferred method, photographs collected by an individual are arranged in a simple chronological order and placed into one or more albums, as needed, in the photoreceiving sheets from the earliest photograph through to the latest photograph. Within the particular time span, photographs may be arranged by events or subject matter to further index and arrange the photographs. Each album is then marked in accordance with the present invention with the following information:

1. The surname (32) of the collector or owner of the collection.
2. The years or time period (34) covered by photographs in the individual album or sub-collection of albums.
3. The volume number (36) of the individual album.

A designation of the origin (38) of the album may also be shown. In the instant invention the stylized P could represent the manufacturer of the album.

The area 28 could also have additional information such as catalog ordering information or country of manufacture, year of manufacture, etc. as needed. Additional spaces could be provided to provide additional information, or fewer spaces could be used to present a more open presentation. Additional information could also be represented on the spine such as the names of occasions or events or other information as needed. Also, one skilled in the art would recognize that the placement of indicia into different areas on the spine or on the cover could be accomplished without straying from the teaching of the present invention.

The album should be sized to practically maintain a sufficient number of photographs. Too many photographs in an album make it difficult to find an individual photograph and diminish the usefulness of having labeled photo albums. Too small of a capacity for maintaining pictures in an album reduce the efficiency and usefulness of organizing photographs into albums. The album should also be sized to adequately protect and maintain various sized photo receiving sheets within the boundaries of the cover to prevent pages from extending beyond the covers and becoming bent or torn by the surrounding environment. The photo receiving sheets should be able to receive photographs of various sizes without wasting large amounts of space while providing for maximum flexibility.

Accordingly, according to the following examples of the present invention, the following dimensions have proven to be ideal for the photo albums.

EXAMPLE 1

Large Photo Album

Vertical Length (Height) of Cover, exterior 13⅝ inches (34.5 cm)

Width of Cover, exterior 14¾ inches (37 cm)

3 Ring Binder height 11 inches (28 cm)

Width of Binder 1⅛ inches (3 cm)

Photo receiving pages height 13 inches (33 cm)

Width of photo receiving pages 13⅛ inches (33.25 cm)

Spine Width 2 inches (5 cm)

Length from bottom of spine to bottom of lowermost divider: 1 5/16 inches (4 cm)

Divider height (measure in plane with spine) 5/16 inch (7 mm)

Spacing between dividers 3/16 inch (3 mm)

Length from top of spine to top of topmost divider: 1 5/16 inches (4 cm)

Five indicia receiving spaces total. Four sets of dividers having two dividers in each set. The remaining indicia receiving spaces are divided equally among the remaining space on the spine.

EXAMPLE 2

Small Photo Album

Vertical Length (Height) of Cover, exterior 11⅞ inches (30 cm)

Width of Cover, exterior 11 1/16 inches (20 cm)

3 Ring Binder height 11inches (28 cm)

Width of Binder 1⅛ inches (3 cm)

Photo receiving pages height 11 15/16 inches (29 cm)

Width of photo receiving pages 9¼ inches (23.5 cm)

Spine Width 2 inches (5 cm)

Length from bottom of spine to bottom of lowermost divider: 1 5/16 inches (4 cm)

Divider height (measure in plane with spine) 5/16 inch (7 mm)

Spacing between dividers 3/16 inch (3 mm)

Length from top of spine to top of topmost divider: 1 5/16 inches (4 cm)

Four indicia receiving spaces total. Four sets of dividers having two dividers in each set. The remaining indicia receiving spaces are divided equally among the remaining space on the spine.

It is to be understood that the present invention is not limited to the sole embodiment described above, but encompasses any and all embodiments within the scope of the following claims.

I claim:

1. A method of providing a comprehensive photograph collection system comprising the steps of:

(a) collecting a plurality of photographs;

(b) categorizing the photographs by dates and subject matter;

(c) providing at least one binder having an outer spine and means defining an interior having a plurality of photograph receiving sheets therein;

(d) storing said categorized photographs in said photograph receiving sheets in said binder; and (e) labeling said outer spine with information about said photographs, wherein said information includes indicia representing said dates and subject matter of said photographs.

2. The method of claim 1, wherein said information also includes indicia representing a volume number for said binder.

3. The method of claim 1, wherein said information also includes indicia representing a family surname.

4. The method of claim 1, wherein said date information is a yearly span.

5. The method of claim 1, further including the steps of:

(f) providing a plurality of said binders;

(g) segregating said photographs into multiple volumes;

(h) further marking said outer spine with indicia representing said a volume number associated with said binder.

6. The method of claim 1, wherein said provided binder has a vertical length 13 to 14 inches along said outer spine and a horizontal width of 14 to 15 inches orthogonal to said vertical length.

7. The method of claim 1, wherein said provided binder has a vertical length 11 to 12 inches along said outer spine and a horizontal width of 11 to 12 inches orthogonal to said vertical length.

8. The method of claim 1, wherein said provided binder is a three ring binder.

9. A method of providing a comprehensive photograph collection system comprising the steps of:

(a) collecting a plurality of photographs;

(b) categorizing the photographs by dates and subject matter;

(c) providing at least one binder having an outer spine and means defining an interior having a plurality of photograph receiving sheets therein;

(d) stretching a piece of leather substantially the area of said binder across a template;

(e) shaping said leather to pattern said leather;

(f) storing said categorized photographs in said photograph receiving sheets in said binder;

(g) providing information about said photographs, wherein said information includes indicia representing said dates and subject matter of said photographs;

(h) imprinting said leather with said information by pressing;

(i) mounting the leather to an exterior of said binder to prove a finished cover therefor;

(j) providing a protective case of matching leather to receive said leather binder therein; and (k) storing said binder in said protective case.

10. The method of claim 8, wherein said information also includes indicia representing a volume number for said binder.

11. The method of claim 8, wherein said information also includes indicia representing a family surname.

12. The method of claim 8, wherein said date information is a yearly span.

13. The method of claim 8, further including the steps of:

(i) providing a plurality of said binders;

(j) segregating said photographs into multiple volumes;

(k) further marking said outer spine with indicia representing said a volume number associated with said binder.

14. The method of claim 8, wherein said provided binder has a vertical length 13 to 14 inches along said outer spine and a horizontal width of 14 to 15 inches orthogonal to said vertical length.

15. The method of claim 8, wherein said provided binder has a vertical length 11 to 12 inches along said outer spine and a horizontal width of 11 to 12 inches orthogonal to said vertical length.

16. The method of claim 8, wherein said provided binder is a three ring binder.

* * * * *